United States Patent [19]

Archer

[11] 4,031,494

[45] June 21, 1977

[54] MULTIPLE PATH SEALED SPRING SWITCH

[75] Inventor: Wendel Edward Archer, Gahanna, Ohio

[73] Assignee: Bell Telephone Laboratories, Incorporated, Murray Hill, N.J.

[22] Filed: Oct. 21, 1975

[21] Appl. No.: 624,333

[52] U.S. Cl. ..... 335/154; 200/283; 335/196

[51] Int. Cl.[2] ..... H01H 1/02; H01H 51/06

[58] Field of Search ..... 335/154, 152, 151, 196, 335/153, 199; 200/283; 317/154

[56] References Cited

UNITED STATES PATENTS

| | | | |
|---|---|---|---|
| 1,968,198 | 7/1934 | Gibbs | 317/154 |
| 2,509,590 | 5/1950 | Galt, Jr. | 317/154 |
| 3,249,728 | 5/1966 | Sasamoto et al. | 200/283 |
| 3,259,715 | 7/1966 | Wagar | 335/154 |

*Primary Examiner*—Harold Broome
*Attorney, Agent, or Firm*—William H. Kamstra

[57] ABSTRACT

A sealed reed spring switch in which a single pair of contacting springs carries two or more electrically insulated conducting paths. The electrically conductive, magnetically responsive springs are coated with an insulating material at least on opposing surfaces over which two or more distinct conductive coatings are formed. Two circuits such as a telephone tip and ring circuit, for example, may be simultaneously controlled by a single sealed two-path switch unit.

4 Claims, 2 Drawing Figures

MULTIPLE PATH SEALED SPRING SWITCH

BACKGROUND OF THE INVENTION

This invention relates to electromagnetically actuated electrical switches and more particularly to such switches having spring contacts sealed in an enclosing envelope.

Sealed contact switches are well known in the electrical arts and long have found extensive application in electrical systems for performing a wide range of switching functions. These switches typically take the form of a pair of overlapping reed springs of a magnetically responsive and electrically conductive material suspended at their ends by the envelope, usually glass, in which they are sealed. A winding encircling the envelope is energizable to generate a magnetic field for actuating the reed springs to control the electrical circuit in which the switch may be connected. Although sealed reed springs having more than two springs for controlling multiple electrical circuits are known, the switch form most generally available and in widest use incorporates only one pair of springs to control the continuity of a single conducting path. Although the advantages of a switch having a number of spring pairs enclosed in a single envelope would appear obvious from both a cost and a packaging viewpoint, the problems encountered in encapsulating even a single pair of springs have not in the past encouraged the use of such a multi-spring pair construction. Such a construction compounds the problem, for example, of providing a positive glass-to-metal seal where the spring members extend through the envelope. The fabrication of a multi-spring switch is also complicated by the necessity of assuring the proper tensioning of the springs and of maintaining a critical spacing between these members. As a result, it has in the past generally been more convenient simply to provide separate switches to control individual circuit paths such as, for example, the tip and ring circuits of a telephone system.

It is an object of this invention to provide a single sealed spring switch for controlling a plurality of conducting paths without aggravating the problems hitherto encountered in the fabrication of sealed, multi-spring pair devices.

Another object of this invention is to provide a new and novel unitary sealed spring switch construction for simultaneously controlling more than one electrical conducting path.

SUMMARY OF THE INVENTION

The foregoing and other objects of this invention are realized in one illustrative embodiment thereof comprising a pair of magnetically responsive spring members arranged in parallel axes to overlap each other at one end to present opposing faces. The spring members are sealed in, and supported at the other ends by a substantially cylindrical envelope of glass or other suitable encapsulating material. The spring members each have plated thereon, at least on their opposing faces, an electrically insulated coating. The latter coating on each spring member in turn has plated or otherwise affixed thereon two or more layers of an electrically conductive material lying parallel with the axes of the spring members and electrically separated from each other. The switch is intended to be actuated by the energization of a winding encircling the envelope as the result of which the electrical contact of the respective conductive layers of the spring members is controlled.

It is thus a feature of a sealed switch arrangement according to this invention that a single pair of springs is employed for the simultaneous control of a plurality of conducting paths. Advantageously, the fabrication of the switch adds no problems to those which may normally be encountered in the manufacture of single path sealed switches.

BRIEF DESCRIPTION OF THE DRAWING

The objects and features of a switch arrangement according to the principles of this invention will be better understood from a consideration of the detailed description of the organization of one specific illustrative embodiment thereof which follows when taken in conjunction with the accompanying drawing in which.

DETAILED DESCRIPTION

Figure 1:
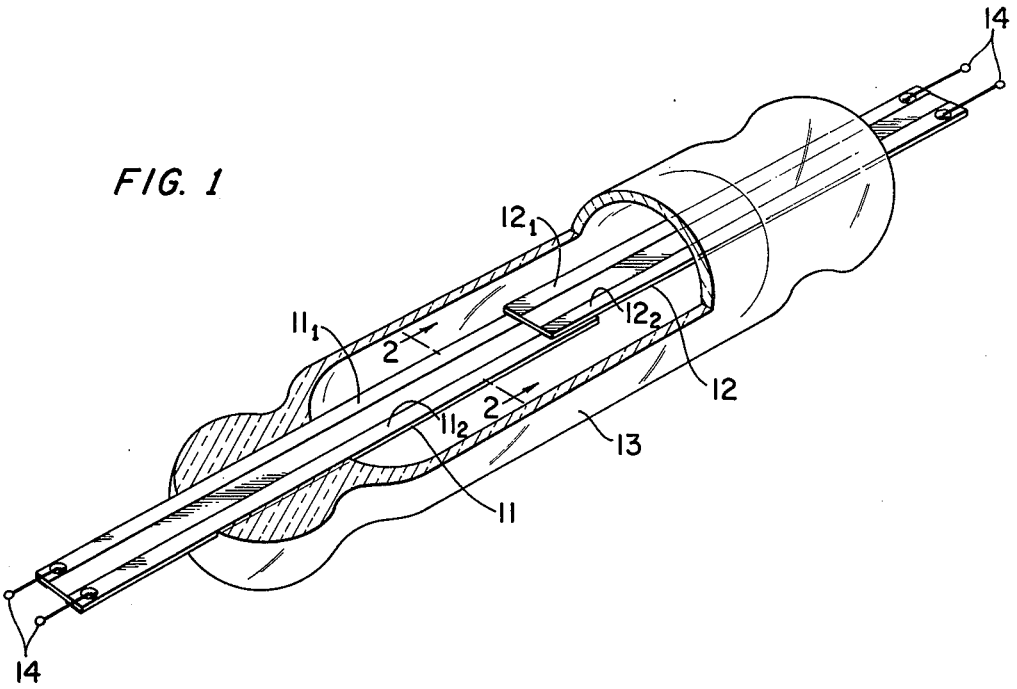
FIG. 1 depicts in three-quarter view one specific switch construction according to this invention with a portion broken away more clearly to disclose the relationship of the component elements, actuating winding means not being shown.

One illustrative switch construction according to the principles of this invention is depicted in FIG. 1 and comprises a pair of elongated flat spring members 11 and 12 lying in substantially parallel axes to overlap at respective ends in a spaced-apart relationship (if the switch is to be operated in a normally open mode). The spring members 11 and 12 at the overlapping ends are sealed in a substantially cylindrical envelope 13, typically of glass, which envelope 13 also supports the members 11 and 12 at opposite ends as they extend through the envelope end walls. In conventional "dry reed" fashion, the envelope 13 may contain an inert gas. The spring members 11 and 12 are each formed of a magnetically responsive, electrically conductive material which material may comprise a remanent magnetic material such as remendur, for example, should a circuit application call for a latching type switch to obviate holding currents.

Figure 2:
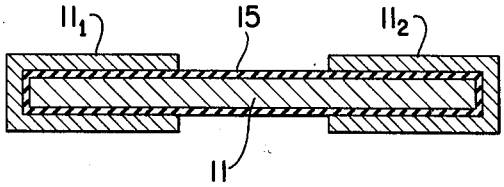
FIG. 2 is a section view of one of the spring members of the construction of FIG. 1 taken along the line 2—2 of the latter figure.

Each of the spring members 11 and 12, in the specific embodiment being described, carries a pair of electrical conducting paths $11_1$ and $11_2$ and $12_1$ and $12_2$, respectively, which at the external ends of the spring members may be provided with suitable terminals 14. The conducting paths are electrically insulated from the members 11 and 12, as is more clearly shown in the section view of FIG. 2 to be considered, and may at the overlapping opposing faces of the spring members be provided with contact means, not shown, to ensure positive electrical continuity. The character of the spring members 11 and 12 is more clearly shown in FIG. 2 where the member 11 is shown in a section view taken along the line 2—2 of FIG. 1. The exemplary flat spring member 11 during fabrication is coated with or has otherwise affixed thereon in its entirety an electrically insulating layer 15 such as, for example, a heat-absorbent glass used in sealed contact manufacture. The coated member 11 is then provided with an overall layer of precious metal such as gold for the ultimate realization of the conducting paths $11_1$ and $11_2$. The outer conductive layer is readily separated into two distinct paths by suitably etching or stripping away the outer layer to provide electrical isolation. Techniques for applying the coatings and for etching or stripping are well known and need not be described here. Although this fabrication method envisioned the coatings as initially covering all of the surfaces of a spring member, it will be appreciated that only the opposing faces of the members need be provided with conducting paths and in such case, only those surfaces would require an initial insulating coating. The mass production of the spring members, on the other hand, is facilitated if no care need be exercised in distinguishing among the spring surfaces. The fabrication time of the switches proper, particularly if automated, is also significantly reduced if stock spring members may be operated upon without regard to end or side.

A multi-path sealed spring switch has been described in the foregoing which advantageously reduces the number of switch units required in a circuit application — here by half — and is relatively economical and simple to manufacture. Although the exemplary switch described provides for only two conducting paths, it will be appreciated that additional paths are readily realized by simply retaining additional bonds of conducting layer material on the spring members. In any case, only a single pair of spring members is required, the dimensions of these being adjusted to accommodate the added paths. A number of circuits may then be simultaneously controlled by a single switch unit. The energizing winding for such control is not shown in the drawing, the character and operation of conventional windings being well known in the art and a description not being necessary for a complete understanding of this invention.

What has been described is considered to be only one specific embodiment of a switch construction according to the principles of this invention and it is to be understood that various and numerous modifications may be made in the construction by one skilled in the art without departing from its spirit and scope. For example, as another variant, should a nonconductive magnetically responsive material be employed for the fabrication of the spring members, clearly the insulating layer 15 may be dispensed with. The scope of the invention is thus limited only as defined in the accompanying claims.

What is claimed is:

1. An electrical switch structure comprising a pair of magnetically responsive flat spring members arranged to present opposing faces and each being further arranged to present an overlap portion to the other at one end, said members being supported at the other ends, and a plurality of conducting paths comprising a plurality of electrically isolated conductive coatings on each of said spring members at least on said opposing faces, said spring members being flexible responsive to the presence of a magnetic field for controlling the electrical contact of respective ones of said conducting paths at said overlap portions.

2. An electrical switch structure comprising a pair of magnetically responsive, electrically conductive flat spring members arranged to present opposing faces and each being further arranged to present an overlap portion to the other at one end, said members being supported at the other ends, an electrically insulating coating on said spring members at least on said opposing faces, and a plurality of conducting paths comprising a plurality of electrically isolated conductive coatings on said insulating coating at least on said opposing faces, said spring members being flexible responsive to the presence of a magnetic field for controlling the electrical contact of respective ones of said conducting paths at said overlap portions.

3. An electrical switch structure as claimed in claim 2 also comprising an envelope for sealably enclosing said spring members and for supporting said members at said other ends.

4. An electrical switch assembly comprising a pair of magnetically responsive, electrically conductive, flat spring members arranged to present opposing faces and each being further arranged to present an overlap portion to the other at one end, an electrically insulating coating on each of said spring members at least on said opposing faces, a plurality of conducting paths carried on said spring members comprising a plurality of electrically isolated conductive coatings on said insulating coating at least on said opposing faces, and an envelope for sealably enclosing said spring members and for supporting said members at said other ends, said spring members being flexible responsive to the presence of a magnetic field for controlling the electrical contact of respective ones of said conducting paths at said overlap portions thereof.

* * * * *